United States Patent [19]

Aronson et al.

[11] 4,052,273

[45] Oct. 4, 1977

[54] METHOD OF ANODIZING POROUS TANTALUM

[75] Inventors: Bernard S. Aronson, Elmira; James A. Murphy, Painted Post, both of N.Y.

[73] Assignee: Corning Glass Works, Corning, N.Y.

[21] Appl. No.: 477,676

[22] Filed: June 10, 1974

[51] Int. Cl.[2] ..... C25D 5/50; C25D 11/00

[52] U.S. Cl. ..... 204/37 R; 204/42; 204/56 R

[58] Field of Search ..... 204/35 R, 35 N, 42, 204/37 R, 56 R; 29/25.42

[56] References Cited

U.S. PATENT DOCUMENTS

| | | | |
|---|---|---|---|
| 2,785,116 | 3/1957 | Bolton et al. | 204/37 R |
| 3,282,807 | 11/1966 | Burnham | 204/37 R |
| 3,378,471 | 4/1968 | Vermilyea | 204/56 R |
| 3,398,067 | 8/1968 | Raffalovich | 204/37 R |
| 3,461,047 | 8/1969 | Jenny | 204/37 R |
| 3,466,230 | 9/1969 | Carithers | 204/38 |
| 3,653,119 | 4/1972 | Fresia et al. | 29/585 |

OTHER PUBLICATIONS

"The Surface Treatment of Aluminum" by S. Wernick et al., 3rd edition, Draper Ltd., Teddington, England, 1964, pp. 269-271, 348, 520-524.

*Primary Examiner*—John H. Mack
*Assistant Examiner*—Aaron Weisstuch
*Attorney, Agent, or Firm*—Walter S. Zebrowski; Clarence R. Patty, Jr.

[57] ABSTRACT

A method of anodizing porous tantalum material suitable for making a porous tantalum capacitor pellet or slug having decreased current leakage is described. After a pellet is anodized at a maximum predetermined desired voltage, it is removed from the anodizing bath and heated to a temperature of between 150° C. and 300° C. The pellet is maintained at such temperature for at least three minutes and then returned to the anodizing bath, at least once, and subjected to more electrical current.

4 Claims, 3 Drawing Figures

METHOD OF ANODIZING POROUS TANTALUM

BACKGROUND OF THE INVENTION

1. Field of the Invention

The present invention relates to a method of anodizing and treating a porous tantalum pellet suitable for use as the anode in a solid or wet tantalum capacitor.

2. Description of the Prior Art

In the manufacture of porous tantalum pellets or slugs for solid or wet capacitor anodes, it has been necessary to pass a predetermined level of current through the pellet in an anodizing bath until a predetermined voltage is achieved. This voltage is usually 50 to 100% higher than the ultimate voltage rating of the capacitor. The anodization is continued at such voltage for 2 hours or more until the current has sufficiently decreased for commercial acceptability. Such an abnormally long period of time adds greatly to the cost of manufacturing a capacitor and does not, even then, reduce the leakage current to a desirable level.

SUMMARY OF THE INVENTION

The objects of this invention are to provide a method for anodizing a porous tantalum pellet which is economical, substantially reduces the leakage current, and overcomes the heretofore noted disadvantages.

Broadly according to the present invention, an ordinary anodizing bath of an aqueous nitric acid solution is prepared and a porous tantalum pellet is disposed in the bath. An electrical current of up to 90 ma(milliamps) per gram of pellet weight is passed through the pellet for a period of at least 30 minutes, the current being substantially constant until a predetermined desired voltage is reached and thereafter the voltage remains substantially constant, while the current decreases. The pellet is then removed from the bath and heated to a temperature of between 150° C. and 300° C. and maintained at that temperature for at least three minutes. The pellet is then returned to the anodizing bath and an electrical current is passed through the pellet at a voltage of up to about the predetermined desired voltage for at least one minute more. Depending on the desirability of reducing leakage current the heating and reanodizing steps may be repeated two or three times.

Additional objects, features, and advantages of the present invention will become apparent to those skilled in the art from the following detailed description and the attached drawings on which, by way of example, only the preferred embodiment of this invention is illustrated.

DETAILED DESCRIPTION OF THE DRAWING

It is to be noted that the drawings are illustrative and symbolic of the invention, and there is no intention to indicate scale or relative proportion of the elements shown therein. For purposes of simplicity, the present invention will be described in connection with the anodization of a porous tantalum pellet suitable for use as an anode in a capacitor.

Figure 1:
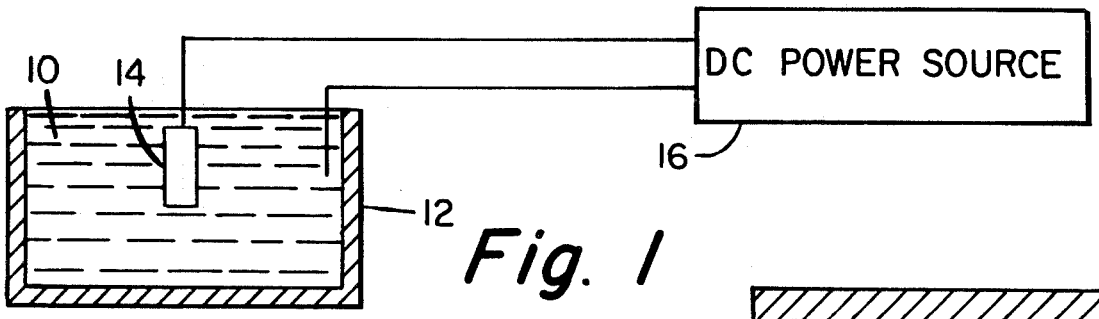
FIG. 1 is a cross-sectional view of an anodizing bath in which a capacitor pellet is disposed.

Referring to FIG. 1 of the drawing, there is shown an anodization bath 10 in container 12. Such anodization baths are known in the art and may be a 0.1N nitric acid solution.

A porous tantalum pellet 14 is prepared by sintering a quantity of tantalum powder to the size and shape ultimately desired. The pellet is then disposed in the bath and connected to a suitable DC power source 16. As will be understood, a film or layer of $Ta_2O_5$ is then formed by passing DC current through the pellet. The amount of electrical current that can be reasonably passed through the pellet is up to about 90 ma per gram of pellet weight. For the usual weights of capacitor anodes and a suitable rate of $Ta_2O_5$ formation, a current of 30 ma per gram is quite suitable. This current is passed through pellet 14 until the desired thickness of $Ta_2O_5$ is formed on the porous pellet surfaces at which time a voltage will be reached which is generally regarded as 50 to 400 percent higher than the rated voltage. The thickness of the $Ta_2O_5$ film determines the ultimate capacity of the capacitor as will be understood by those familiar with the art.

Figure 3:
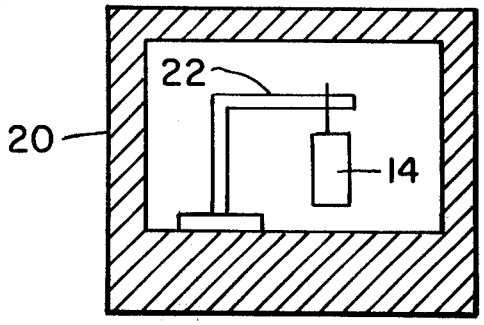
FIG. 3 is a cross-sectional view illustrating the heating of a capacitor pellet.
Figure 2:
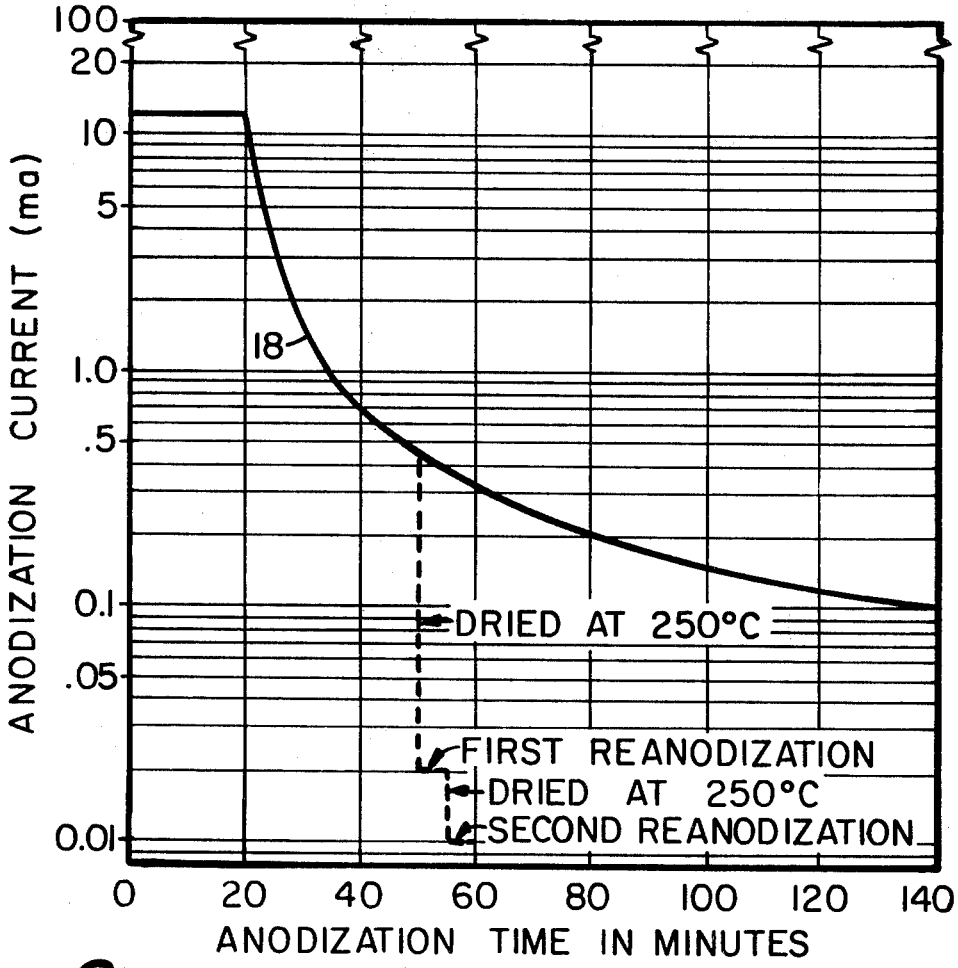
FIG. 2 is a graph illustrating capacitor leakage current decrease vs. time after anodization and successive reanodization.

The pellet is anodized for a period of at least 30 minutes and up to about 1 hour at voltage. During this time, this is up to 30 minutes, the current leakage is significantly decreased; however, after 30 minutes the decrease is significantly slowed as illustrated in FIG. 2 by curve 18. The pellet is removed from anodization bath 10 and placed in furnace 20 supported by suitable support 22 as shown in FIG. 3. Pellet 14 is heated to a temperature of between 150° C. and 300° C. and is maintained at that temperature for at least three minutes and up to 10 to 15 minutes. During this heating step, pellet 14 is thoroughly dryed. The usual time for maintaining pellet 14 at this elevated temperature is about 5 minutes.

The pellet is then removed from the furnace and again placed in the anodization bath 10. During this reanodization step, the current is passed through the pellet for at least one minute up to about ten minutes at a voltage up to the previously determined maximum voltage. It has been determined that the leakage current at this predetermined maximum voltage will be approximately one order of magnitude lower than at the end of the initial anodization step as shown in FIG. 2.

The pellet is thereafter removed from the anodization bath and returned to the furnace and the heating step repeated. After a second heating step and return to the anodization bath, the leakage current through the pellet is further decreased by an additional factor of up to about two. These process steps may be repeated as many times as desired and each time an improvement in the leakage current is found although the improvement is less each time. It has been found that two reanodization steps following the initial anodization step produces a capacitor anode having markedly decreased current leakage over similar prior art capacitors.

As a typical example, a porous tantalum pellet having a weight of 0.4 grams is formed. An anoidization bath of 0.1N nitric acid solution is prepared. The porous tantalum pellet is connected to a suitable DC power source and disposed in the bath. A current of 30 ma. per gram of pellet weight is passed through the pellet for a total of 12 ma. After about 20 minutes a voltage of 30.8 volts is reached. At this point the leakage current is 12 ma. The anodization process is continued for an additional 30 minutes at which time the leakage current has decreased to less than about 0.5 ma. The pellet is removed from the anodization bath and placed in a furnace at 250° C. and maintained there for a period of 5 minutes after which it is returned to the anodization bath for an additional 5 minutes. Electric current is passed through the pellet at 30.8 volts and at the end of ten minutes the leakage current is 20 microamps. At this point the leakage current has been reduced by a factor of about 600 measured at 70° C.

At this point the pellet is again removed from the anodization bath and placed in the furnace at 250° C. for an additional 5 minutes after which it is returned to the anodization bath. Again a current at 30.8 volts is passed through the pellet for an additional 5 minutes at the end of which the leakage current is 10 microamps. This is a further reduction in leakage current by a factor of 2.

The above pellet is suitable to form the anode of a capacitor having a rating of 56 microfarads and an operating voltage of 30 volts.

As is seen from the above example, the leakage current has been decreased by the present process from 12,000 microamps when the predetermined desired voltage of 30.8 volts was reached to a value of 10 microamps at the end of the process. This is not only a substantial decrease in a leakage current but also a substantial decrease in a time of processing the pellet to a point where it is ready to be formed into a capacitor anode.

Although the present invention has been described with respect to details of certain embodiments thereof it is not intended that such details be limitations upon the scope of the invention except insofar as set forth in the following claims.

We claim:

1. The method of anodizing a porous tantalum pellet comprising the steps of providing a porous tantalum pellet, preparing an anodizing bath of an aqueous nitric acid solution, disposing said pellet in said anodizing bath, passing an electrical current of up to 90 ma. per gram of pellet weight through said pellet for a period of at least 30 minutes, said current being substantially constant until a predetermined desired voltage is reached and thereafter said voltage remaining substantially constant, removing said pellet from said bath, heating said pellet to at a temperature of between 150° C. and 300° C., maintaining said pellet at said temperature for at least 3 minutes to dry out the pores therein, returning said pellet to said anodizing bath, passing an electrical current through said pellet at a voltage up to about said predetermined desired voltage for at least one minute, and thereafter removing said pellet from said bath.

2. The method of claim 1 further comprising the steps of heating said pellet for a second time to a temperature of between 150° C. and 300° C., p1 maintaining said pellet at said temperature for at least three minutes to dry out the pores therein, returning said pellet to said anodizing bath for the third time, and passing an electrical current through said pellet at a voltage up to about said predetermined desired voltage for at least one additional minute.

3. The method of claim 1 wherein said electrical current is 30 milliamps per gram of pellet weight.

4. The method of claim 1 wherein said temperature to which said pellet is heated is about 250° C.

* * * * *